US005738240A

United States Patent [19]

Vavra et al.

[11] Patent Number: 5,738,240

[45] Date of Patent: Apr. 14, 1998

[54] COMPOSITE SHIPPING CONTAINER WITH TUBULAR MEMBER PALLET

[75] Inventors: Elaine Kay Vavra, Crete; Scott Charles Higgins; Dwight E. Nichols, both of Beatrice, all of Nebr.

[73] Assignee: Hoover Group, Inc., Alpharetta, Ga.

[21] Appl. No.: 718,004

[22] Filed: Sep. 13, 1996

[51] Int. Cl.[6] ..... B65D 21/00

[52] U.S. Cl. ..... 220/410; 220/1.5; 220/636

[58] Field of Search ..... 220/410, 636, 220/1.5

[56] References Cited

U.S. PATENT DOCUMENTS

| | | | |
|---|---|---|---|
| 2,994,332 | 8/1961 | Leonhardt | 220/636 X |
| 5,002,194 | 3/1991 | Nichols | 220/1.5 |
| 5,029,734 | 7/1991 | Nichols | 222/105 |
| 5,060,815 | 10/1991 | Wendling et al. | 220/1.5 X |
| 5,110,000 | 5/1992 | Nichols | 220/4.16 |
| 5,316,174 | 5/1994 | Schutz | 220/636 X |
| 5,358,137 | 10/1994 | Shuert et al. | 220/410 X |

*Primary Examiner*—Steven M. Pollard

*Attorney, Agent, or Firm*—Harness, Dickey & Pierce, P.L.C.

[57] ABSTRACT

A composite shipping container primarily for shipping bulk liquids consisting of an inner plastic tank held upright by an outer support structure of mesh wire side walls, a top wall and a bottom wall. This outer support structure forms a housing which is supported on a unitary tubular member pallet, which allows the composite shipping container to freely stand on a floor surface or stack upon a like composite shipping container. The unitary tubular member pallet is comprised of a single piece of metal tubing shaped into co-planar surfaces for the outer housing to rest on and shaped into feet to set the composite shipping container on a generally horizontal floor or other surface. The configuration of the unitary tubular member pallet reduces the amount of material required to complete the pallet and eases pallet construction.

1 Claim, 2 Drawing Sheets

COMPOSITE SHIPPING CONTAINER WITH TUBULAR MEMBER PALLET

BACKGROUND AND SUMMARY OF INVENTION

The invention is a new design for a composite shipping container. This type of shipping container is generally used for bulk liquids. The shipping container is composed of a relatively thin wall inner synthetic resin tank enclosed by a housing which provides support for the inner tank. The enclosed tank rests upon a tubular member base, which allows it to freely stand on a floor surface, or to stack on other like shipping containers.

An example of a composite shipping container known to the industry is U.S. Pat. No. 4,793,519 which is commonly assigned to the Assignee of the present application. The general design for this type of composite shipping container consists of an inner resin or poly tank which is enclosed by an outer frame of sheet metal, a metal cage or corrugated paper, keeping the inner tank in an upright position. The inner tank is filled with a liquid or other material for storage, and the composite container is placed on a pallet made of wood or metal. These pallets are normally designed to allow forklift handling through holes placed in the boxlike structures.

The wood or metal pallets in previous designs have been made out of multiple parts, requiring significant assembly. These designs have been inefficient, using an excessive amount of the wood or metal material, and also requiring costly assembly procedures.

With the limitations of the prior art in mind, it is the object of this invention to improve upon pallets used in previous designs to provide a new more economical pallet which is both easier to assemble and is also comprised of less material than previous designs.

The object of this invention is to create a composite shipping container with a pallet composed of tubing made of galvanized metal or any such appropriate material, forming a pallet which is both sturdy and economical.

It is another object of this invention to form the pallet for the composite shipping container from a single pad, a unitary piece of tubing composed of galvanized metal, or any such appropriate material, wherein assembly requires no additional materials.

In achieving the above mentioned objectives, the tubular member pallet is formed from one piece of tubing, easing the construction process, and leaving less room for manufacturing error or mechanical failure than in previous designs. Because there are no parts to attach to the pallet, the chance of part failure is eliminated and the materials, such as bolts, required for pallet assembly are also eliminated. The amount of the metal material required for the pallet is reduced from previous boxy pallet designs, as the tubular base is formed into an "H" shape with feet, which requires less material than previous pallet structures.

The tubular member pallet is designed so that forklift tines will fit between the pallet and the floor surface it rests upon. The tubular member is formed into co-planar surfaces for the bulk liquid container to rest upon and into feet so that the composite shipping container may rest freely upon a floor surface, or stack upon a second composite shipping container with a tubular member pallet.

Additional benefits and advantages of the present invention will become apparent to those in the art to which this invention relates from the subsequent description of the preferred embodiments and the appended claims, taken in conjunction with the accompanying drawings.

DETAILED DESCRIPTION OF THE ILLUSTRATED EMBODIMENT

Figure 1:
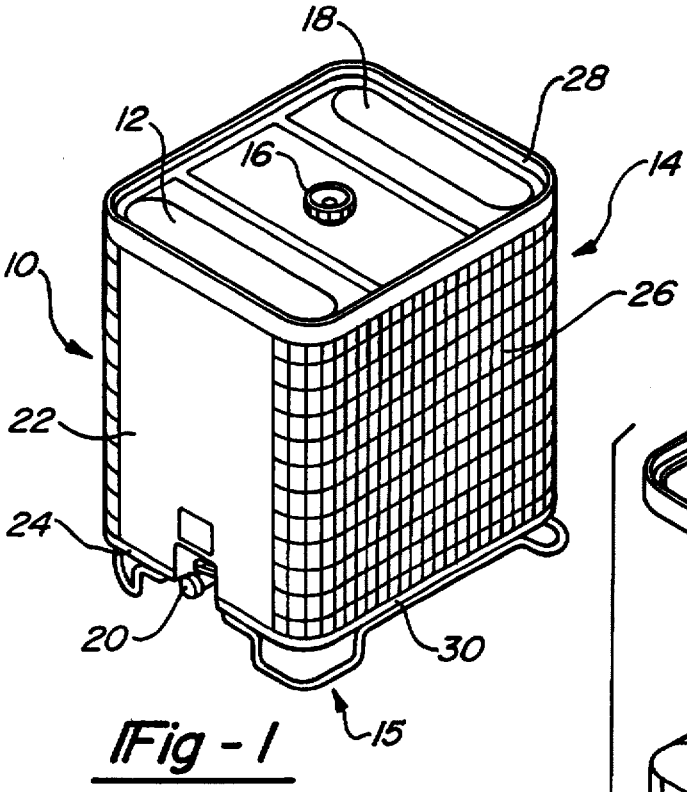
FIG. 1 is a perspective view of a composite shipping container embodying the present invention.

The present invention is described with reference to each of the figures.

With reference to the drawings, the composite shipping container, of this invention, generally designated at 10 consists of an inner plastic tank 12 which is held upright by an outer housing 14, and a tubular member pallet 15 on which the outer housing 14 is supported.

The plastic tank 12 is usually made from a synthetic resin such as high density polyethylene (HDPE) and is well known in the industry. Typically, plastic tanks used as shipping containers have a fill opening or port 16 located in the top wall 18 of the plastic tank 12 and a discharge tube 20 located in a side wall 22 of the plastic tank 12 adjacent to the bottom wall 24 of the plastic tank 12, or actually in the bottom wall 24 of the plastic tank 12. The plastic tank 12 has notably thin walls incapable of holding the tank upright without support from the outer housing 14.

Figure 2:
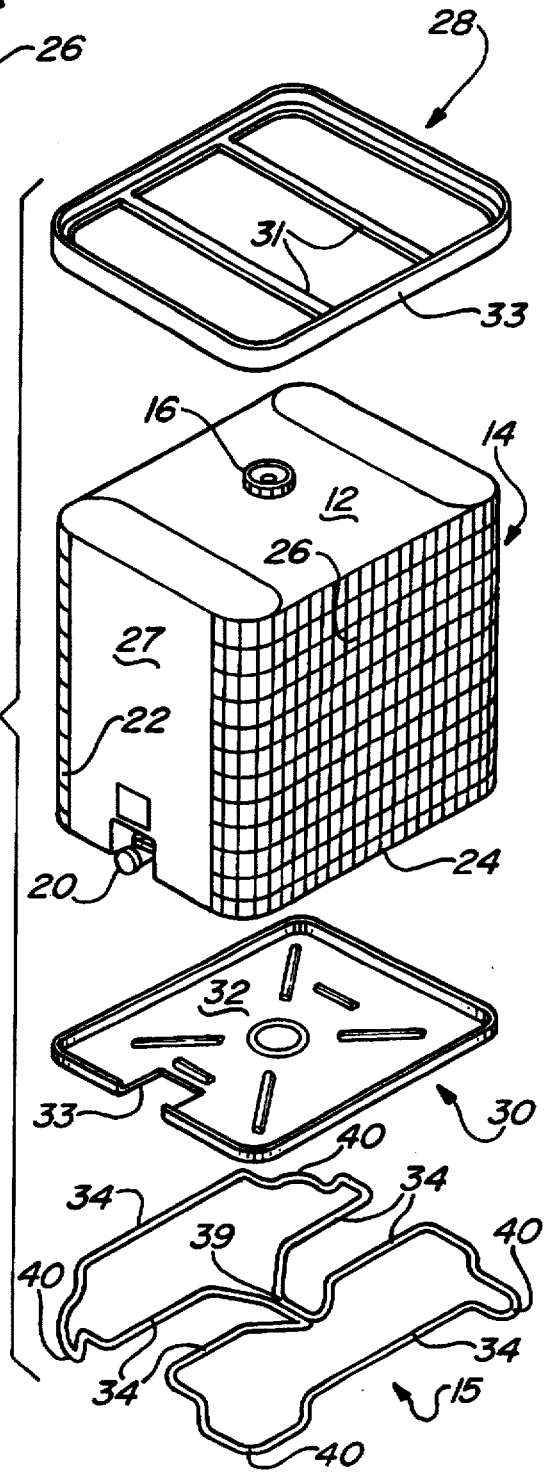
FIG. 2 is an exploded perspective view of the shipping container as seen in FIG. 1.

The outer housing 14 that surrounds the plastic tank 12 consists of side walls 26, a top structure or wall 28 and a bottom structure or wall 30. The upright side walls 26 may be made of a wire mesh, galvanized sheet metal or corrugated paper and may be made with any desired finish. In the preferred embodiment the side walls 26 are constructed with a wire mesh; the wire mesh allowing visible monitoring of the plastic tank 12 and its contents (FIG. 2). The wire mesh is joined by a splice plate 27, which may be placed in any of the side walls 26, but in the preferred embodiment it is aligned with the side wall 22 on the plastic tank 12 containing the discharge port 20, and shaped to create an access opening to the discharge port 20. The size of the splice plate 27 may vary.

Figure 3:
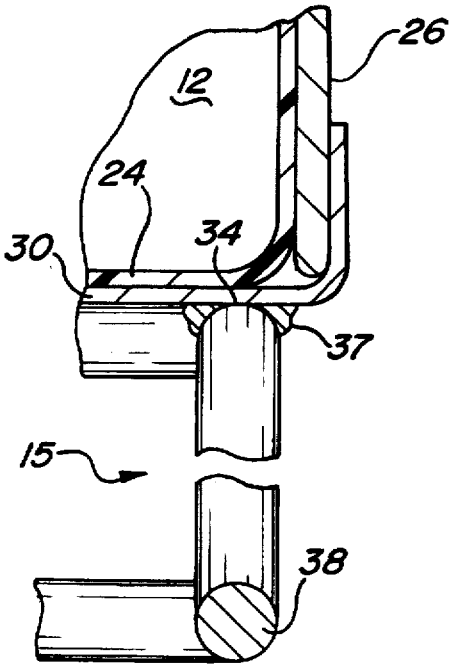
FIG. 3 is an enlarged fragmentary sectional view of a portion of the shipping container illustrating one embodiment of the tubular member pallet secured to the container.

The side walls 26 of the outer housing 14 are attached to the bottom structure 30 along its perimeter. The side walls 26 are attached to the upper surface 32 the bottom structure 30 in a reasonable manner, such as welding, and the top structure 28 is releasably secured to the upper periphery of the side walls 26 so that the plastic tank 12 can be removed or replaced. The top structure 28 may have a solid plate construction, if a hole is left for the fill port 16, but in the preferred embodiment, it consists of struts 31 and a circumferential rim 33. The bottom structure 30 is constructed as a plate formed with opening 33 to allow access to the discharge tube 20. The bottom wall 24 of the plastic tank 12 and the side walls 26 of the outer housing 14 rest upon the upper support surface 32 of the bottom structure 30. The bottom structure 30 is secured by welding 37 to the upper coplanar surfaces 34 of the tubular member pallet 15 (FIG. 3), and the tubular member pallet 15 may rest upon a floor surface or may stack upon a similar composite shipping container 10 (FIG. 1 ).

Figure 4:
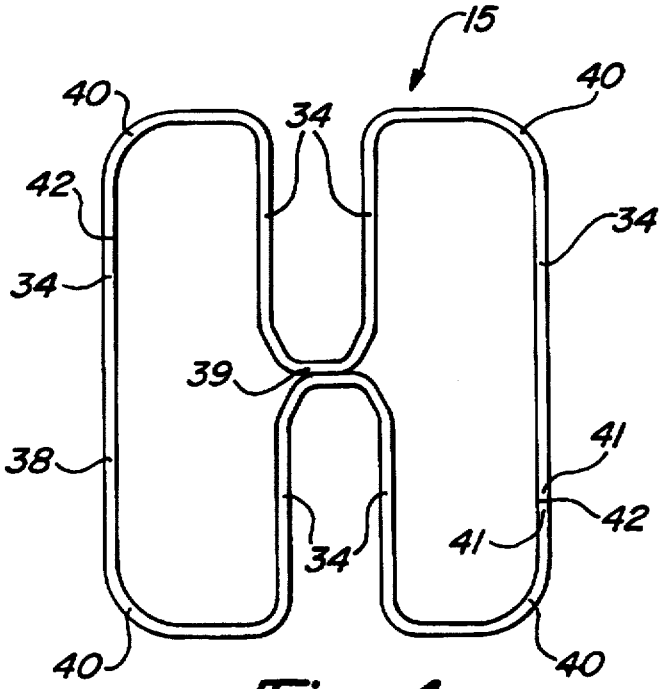
FIG. 4 is a top view of the tubular member pallet embodied in the present invention.

The tubular member pallet 15 is composed of tubing 38 (FIG. 3), which may be made of galvanized metal, or other appropriate material. A double length of tubing 38 is bent and shaped to construct the tubular member pallet 15. The ends 41 of the tubing 38 are secured together to create a continuous tubular member pallet 15. The ends are preferably welded together to form seam joints 42 (FIG. 4).

FIG. 2 shows that the tubular pallet is shaped to form co-planar surfaces 34, upon which the bottom structure 30 directly rests, four circumferential feet 40 and one center foot 39. When viewed from above (FIG. 4), the tubing 38 forming the co-planar surfaces 34, the circumferential feet 40 and the center foot 39 forms an "H" shape.

Figure 5:
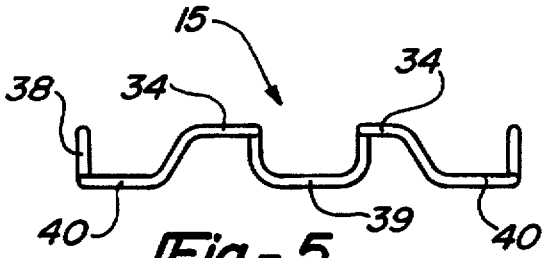
FIG. 5 is a front view of the tubular member pallet embodied in the present invention.

FIG. 5 shows the front of the tubular member pallet 15. The front two circumferential feet 40 are shown to be substantially equal distances on opposite sides of the center foot 39. The circumferential feet 40 and the center foot 39 are the same height, and all support the composite shipping container 10 which is shown in FIG. 1. The unitary tubing 38 is shown to form the circumferential feet 40 and then slope up to form the co-planar surfaces 34.

Figure 6:
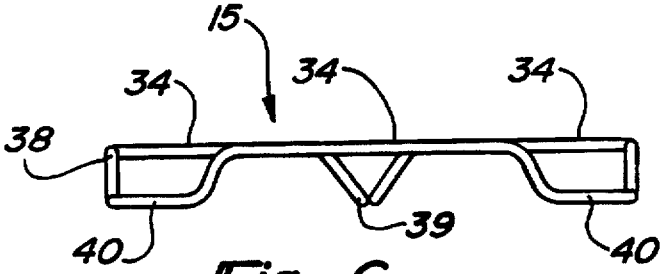
FIG. 6 is a side view of the tubular member pallet.

FIG. 6 is a side sectional view of the tubular member pallet 15. It reveals two of the four circumferential feet 40 located on a side of the tubular member pallet 15 and the center foot 39. The tubing 38 is shown to be one piece shaped to create the circumferential feet 40, the center foot 39 and the co-planar surfaces 34.

From the above description it is apparent that this invention is a new design for a composite shipping container 10. The design includes a tubular member pallet 15 which is formed from two pieces of metal tubing 38 to support the remaining components of the composite shipping container 10 and rest upon a generally horizontal floor surface or stack upon another like composite shipping container 10. The tubular member pallet 15 is constructed of less material and is easier to assemble than previous pallet designs.

While the above description constitutes the preferred embodiments of the present invention, it will be appreciated that the invention is susceptible to modifications and alterations without departing from the proper scope and fair meaning of the accompanying claims.

What is claimed is:

1. A shipping container having a removable inner tank for transporting bulk liquid materials and comprising a bottom structure having an upper support surface for supporting the tank, a housing including upright side walls having upper and lower periphery, said side walls being supported on said support surface and substantially encircling the tank therein, said housing also including a top in engagement with said upper periphery of said side walls thereby enclosing the tank within said housing, securing means for releasably securing said top to said upper periphery of said side walls and for securing said base member to said lower periphery of said side walls, a tubular pallet located below and in a supporting relation with said base member, said pallet being comprised of a unitary tubular member shaped to form substantially horizontal co-planar support sections engagable with the bottom surface of said base member at positions near the center and close to the periphery of said base member, said tubular member being further shaped to form four individual foot sections located at the four corners of said base member and extending downwardly from said support sections thereby enabling said shipping container to freely stand on a horizontal floor surface, said unitary tubular member further being shaped to form a fifth foot section located substantially at the center of said pallet, said support sections and said fifth foot section cooperating to form an H-shape tubular pallet when viewed from above.

* * * * *